US006442849B2

(12) United States Patent
Taomo et al.

(10) Patent No.: US 6,442,849 B2
(45) Date of Patent: Sep. 3, 2002

(54) PORTABLE POWER WORKING MACHINE

(75) Inventors: Toshio Taomo; Fujio Kobayashi, both of Tokyo (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 09/767,562

(22) Filed: Jan. 23, 2001

(30) Foreign Application Priority Data

Jan. 27, 2000 (JP) ..... 2000-018306

(51) Int. Cl.[7] ..... B27B 17/02
(52) U.S. Cl. ..... 30/383
(58) Field of Search ..... 30/381–383, 340

(56) References Cited

U.S. PATENT DOCUMENTS 5,016,355 A * 5/1991 Gassen et al. ..... 30/383
5,570,512 A 11/1996 Hoppner ..... 30/383

* cited by examiner

*Primary Examiner*—Douglas D. Watts
(74) *Attorney, Agent, or Firm*—Baker Botts L.L.P.

(57) ABSTRACT

A portable power working machine has an L-shaped top handle having a top grip portion that is attached to the front portion of the top of a main housing and extends longitudinally above and parallel to the top of the main housing and a rear coupling portion that is attached to the rear portion of the main housing. A side handle has a front grip portion that is connected directly to the front end of the top grip portion of the top handle and a diagonal grip portion that extends diagonally straight as viewed in side elevation from the front grip portion toward the lower end of the rear coupling portion of the top handle. The lower end of the diagonal grip portion of the side handle is connected directly to the rear coupling portion of the top handle.

6 Claims, 6 Drawing Sheets

PORTABLE POWER WORKING MACHINE

BACKGROUND OF THE INVENTION

The present invention relates to a portable power working machine, such as a chain saw, a power cutter, a hedge trimmer and the like. Such machines ordinarily have a top handle, which is usually gripped by the operator with his right hand, and a side handle, which is usually gripped with his left hand. The handles are attached to the main housing. A working member, such as a saw chain or a cutter, extends forwardly from the housing.

In a conventional portable power working machine of the aforementioned kind, the top handle is constituted by a top grip member, which is located above and oriented parallel to a top surface of the main housing and extends in the longitudinal direction of the main housing. The front and rear ends of the top grip member are connected with the front and rear end portions of the upper surface of the main housing, respectively. The side handle is generally a C-shaped tubular body, one end of which (the upper end) is secured to the main housing close to the front end of the top grip member, and the other end of which (the lower end) is secured to a bottom portion of the main housing, at a location vertically below where the upper end is secured to the main housing. Both ends of the side handle are secured to the main housing at about the same location in the longitudinal direction of the main housing, and therefore, the side handle lies in a vertical plane orthogonally intersecting the longitudinal direction of the main housing.

In the operation of the portable power working machine of the type described above, the working position (or posture) thereof is not necessarily the same all the time, but may be required to be varied depending on the working condition. For example, the operator may sometimes hang the working machine from a branch of a tree using a rope, for instance. Depending on the working posture, the operator may have difficulty suitably gripping the side handle, which, as mentioned above, lies in a vertical plane orthogonally intersecting the longitudinal direction of the main housing, thereby badly affecting the working efficiency.

With a view to solving the above problem, there has been proposed, as set forth in Japanese Patent Publication No. 2931234 (U.S. Pat. No. 5,570,512), a portable power working machine (a chain saw) wherein the aforementioned other end (lower end) of the side handle is secured to a lower edge portion of the proximal (rear) end of the main housing, and the central portion of the side handle is curved downwardly diagonally, as viewed from the side.

Although the side handle can be easily gripped, irrespective of the working posture of the machine, the vibrations of the top handle and the main housing are transmitted to the side handle, inasmuch as the other end (lower end) of the side handle is secured to a lower edge portion of the proximal (rear) end of the main housing (recoil starter case). Hence, the operator is not able to sense an integrity between the top and side handles, thus diminishing the operability of the machine. Furthermore, since part of the side handle extends over the main housing, it is required, when performing maintenance or repair work on components housed inside the main housing (such as maintenance and inspection of the prime mover and the recoil starter), to dismount the side handle from the top handle as well as from the main housing, thereby making the performance of maintenance inconvenient.

BRIEF SUMMARY OF THE INVENTION

The present invention has been made in view of overcoming the aforementioned problems. It is an object of the present invention to provide a portable power working machine having a side handle that is easy to grip, irrespective of the working posture of the machine. It is a further object to minimize the transmission of vibrations of the main housing to the side handle, thereby giving the operator a feeling of integrity between the top and side handles and improving the operability of the machine. Another object is to make it easier for the operator to perform maintenance work on the components housed inside the main housing.

With a view to attaining the aforementioned objects, there is provided, according to the present invention, a portable power working machine which includes a main housing having a front end portion, a working member that extends forwardly from the front end portion of the housing, and a prime mover housed in the main housing. A top handle is secured to the main housing, and a side handle is joined to the top handle. The top handle is L-shaped as viewed in side elevation and has a top grip portion disposed above and extending parallel to a top surface of the main housing and in the longitudinal direction of the main housing. A rear coupling portion of the top handle extends from the top grip portion downwardly along the rear side of the main housing. The front end of the top grip portion is connected with the front end portion of the top surface of the main housing. The rear coupling portion of the top handle is coupled with a rear end portion of the main housing. The side handle has one end portion which is connected directly to or molded integrally with the front end of the top grip portion of the top handle close to the front end thereof and the other end portion is connected directly to or molded integrally with the rear coupling portion of the top handle near the lower end thereof.

In a preferred embodiment, said one end portion of the side handle is connected to the front end of the top grip portion by a bolt or the like, and said other end portion of the side handle is connected to a lower end of the rear coupling portion of the top handle by a bolt or the like.

Preferably, the side handle is C-shaped as viewed in plan and has a front grip portion which extends horizontally and laterally from the vicinity of the front end of the top grip portion of the top handle and a diagonal grip portion which curves out and down from the front grip portion and then extends diagonally straight as viewed in side elevation from the front grip portion toward the lower end of the rear coupling portion.

In another preferred embodiment, a vibration isolating member is interposed between the vicinity of the front end of the top grip portion of the top handle and the top surface of the main housing.

In a further preferred embodiment, a vibration isolating member is interposed between the lower end of the rear coupling portion of the top handle and a lower end portion of the rear end portion of the main housing.

The present invention is applicable to such portable power working machines as chain saws, power cutters, hedge trimmers, etc. In the case where the working machine is a chain saw, the working portion thereof is constituted by a saw chain set comprising a guide bar attached to the main housing and a saw chain trained around the guide bar.

According to a preferred embodiment of the portable power working machine, which is constructed according to the present invention, the top handle is L-shaped in side elevation and is constituted by a top grip portion which is located above and parallel to the top surface of the main housing and extends in the longitudinal direction of the main housing and by a rear coupling portion, which extends from the top grip portion toward the rear side of the main housing. The front end of the top grip portion is connected with a front end portion of the top surface of the main housing, and the rear coupling portion is coupled with a rear end portion of the main housing. Furthermore, the side handle is constituted by a front grip portion which extends horizontally and laterally from the vicinity of the front end of the top grip portion and by a diagonal grip portion which curves out and down from the front grip portion and then extends diagonally straight, as viewed in side elevation, from the front grip portion toward the lower end of the rear coupling portion. The front end portion of the front grip portion of the side handle is connected directly to or molded integrally with a portion of the top grip portion of the top handle close to the front end of the top grip portion. The rear end (the other end portion) of the diagonal grip portion of the side handle is connected directly to or molded integrally with the rear coupling portion of the top handle at a location close to the lower end of the rear coupling portion. As a result, the operator can easily grip the side handle (the front grip portion and the diagonal grip portion), irrespective of the working posture of the machine. Furthermore, it is possible, with a portable power working machine embodying the present invention, to give the operator a feeling of integrity between the top and side handles, thus making it possible to improve the operability of the machine as compared with the conventional portable power working machine wherein the other end (lower end) of the side handle is secured to a lower edge portion of the proximal (rear) end of the main housing (recoil starter case).

Inasmuch as it is no longer required, when performing maintenance on the components housed inside the main housing (such as maintenance and inspection of the prime mover and the recoil starter), to dismount the side handle from the top handle, the maintenance work can be facilitated.

Additionally, since a vibration isolating member is interposed between the vicinity of the front end of the top grip portion and the top surface of the main housing, and at the same time, since a vibration isolating member is interposed between the lower end of the rear coupling portion and a lower end portion of the rear end portion of the main housing, the vibration of the handles can be minimized, thus giving the operator a feeling of improved integrity, and making it possible to improve the operability of the working machine.

DESCRIPTION OF THE EMBODIMENT

The illustrated embodiment of the present invention will be explained with reference to the attached drawings as follows.

Figure 1:
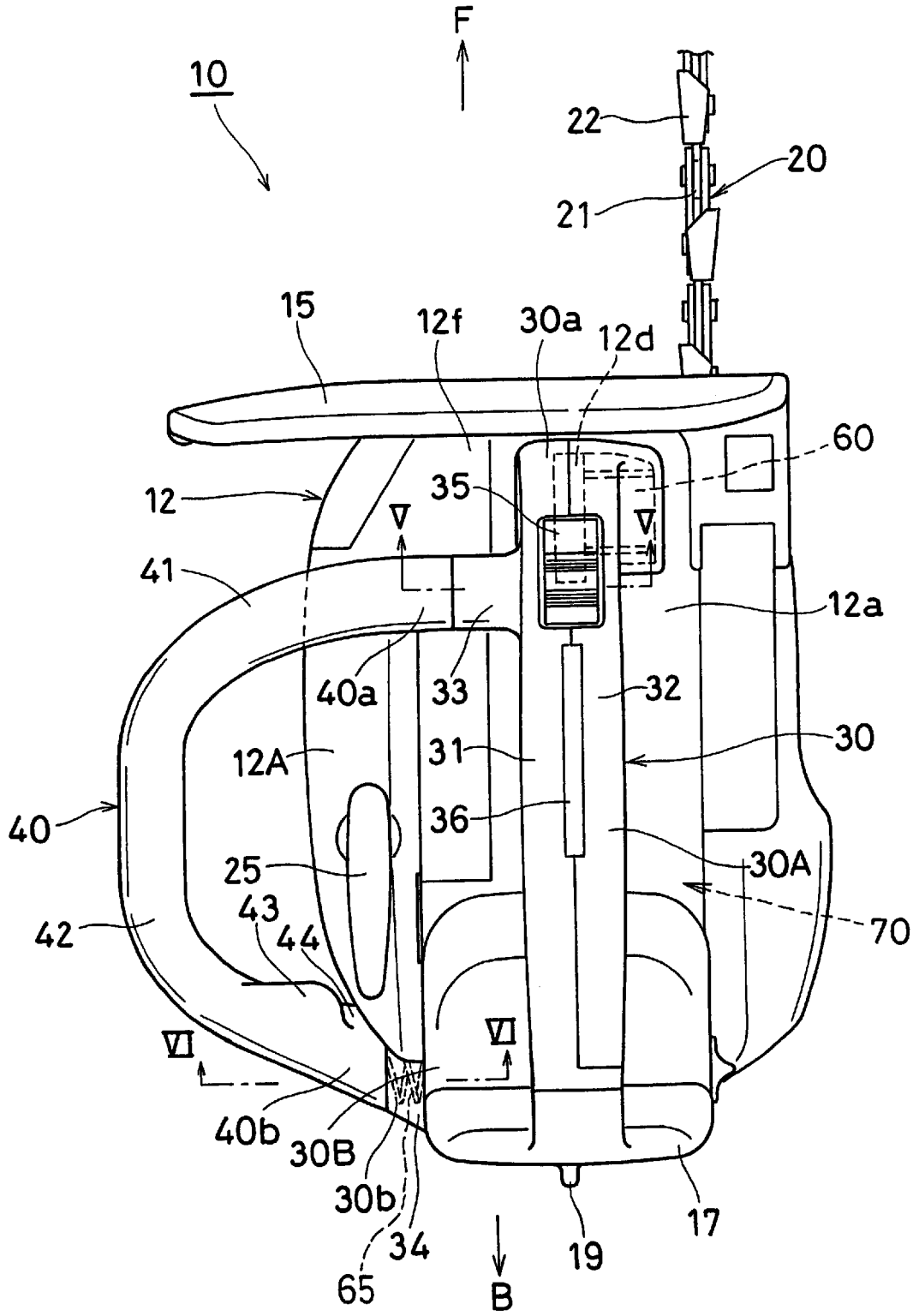
FIG. 1 is a plan view showing one embodiment of a chain saw, which is representative of portable power working machines according to the present invention.
Figure 2:
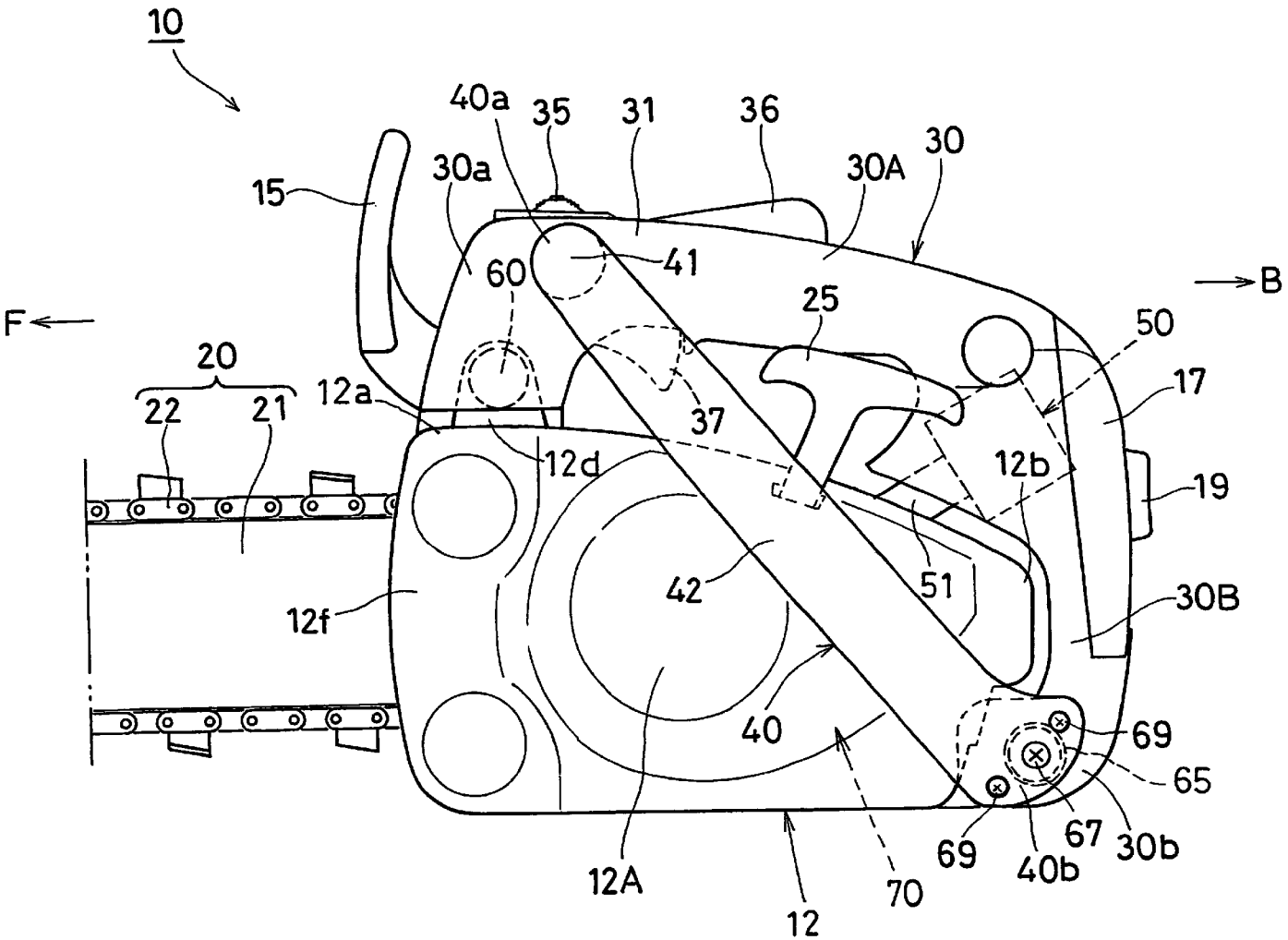
FIG. 2 is a left side view of the chain saw shown in FIG. 1.
Figure 3:
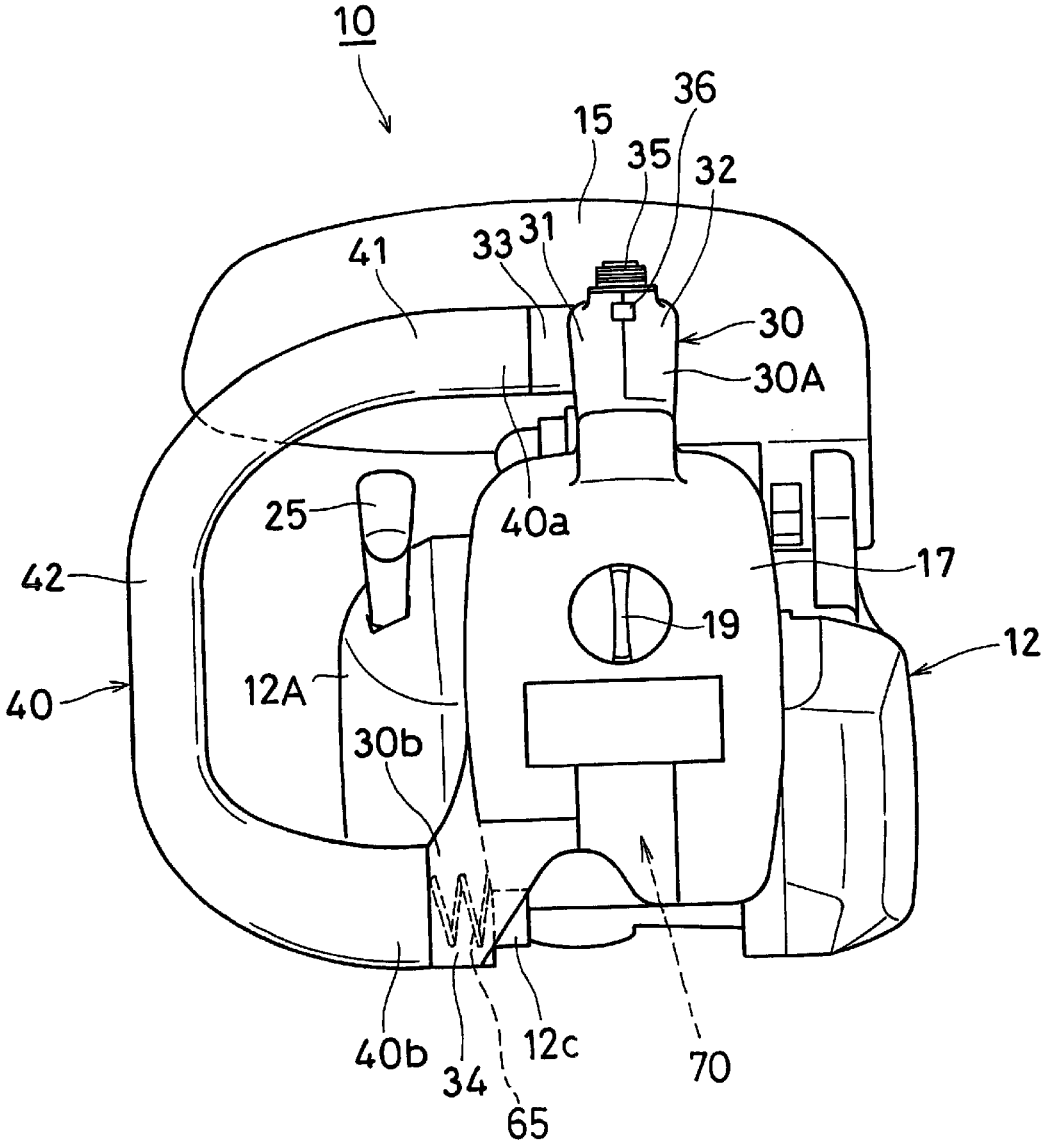
FIG. 3 is a rear side view of the chain saw shown in FIG. 1.

Referring to FIGS. 1, 2 and 3, a chain saw 10 comprises a main housing 12 made of a synthetic resin, and a guide bar 21 around which a saw chain 22 is trained so as to constitute a working member (working portion). The guide bar 21 extends forwardly (the arrow F) from a right portion of the front end 12*f* of the main housing 12.

An air-cooled two-stroke gasoline engine 70, the details of which are omitted, serves as a prime mover by rotatably driving the saw chain 22. The engine 70 is housed inside the main housing 12. A recoil starter case 12A is detachably attached to the left sidewall of the main housing 12 and includes a recoil starter handle 25 at a rear portion on the left side of the engine 70 for starting the engine 70. A hand protection guard 15 is disposed over the front end 12*f* of the housing.

A top handle 30 of L-shape in side elevation is located above the top surface 12*a* of the main housing 12 and extends from the front portion to the rear portion 12*b* of the main housing 12. Further, a side handle 40 is disposed on the left side of the main housing 12 (on the side where the recoil starter case 12A is disposed).

The top handle 30 is constituted by a top grip portion 30A, which is located above and extends parallel to the top surface 12*a* of the main housing 12 and in the longitudinal direction of the main housing 12, and by a rear coupling portion 30B, which extends from the top grip portion 30A toward the rear side of the main housing 12. A front end 30*a* of the top grip portion 30A is connected via a vibration isolating member 60 with a bracket 12*d*, which projects upwardly from the top surface 12*a*. The lower end 30*b* of the rear coupling portion 30B is coupled with a lower end 12*c* of the rear end portion 12*b* of the main housing 12 by means of a bolt 67 (see FIG. 6).

The top handle 30 is of a two-piece structure, consisting of a left side half body 31 and a right side half body 32. The left side half body 31 is constituted by the left side half of the top grip portion 30A and by the rear coupling portion 30B, while the right side half body 32 is constituted only by a right half of the top grip portion 30A. The top grip portion 30A is provided with an engine stop switch 35, a throttle safety lever 36 and a throttle trigger 37. On the rear side of the rear coupling portion 30B, there is detachably mounted an air cleaner cover 17 equipped with a detaching thumbscrew 19. The interior of the rear coupling portion 30B houses a diaphragm carburetor 50 for feeding an air-fuel mixture to the engine 70 through a flexible tube 51.

The tubular side handle 40 of C-shape as viewed in plan has a front grip portion 41 that extends horizontally and leftward from the vicinity of the front end 30*a* of the top grip portion 30A of the top handle 30 and a diagonal grip portion 42 that curves outwardly and downwardly from the front grip portion 30A and then extends diagonally straight as viewed in side elevation from the front grip portion 41 toward the lower end of a rear coupling portion 30B. A constricted portion 40*a* of the front grip portion 41 is inserted into an inner partitioning wall 33*a* of the coupling boss 33, which projects from a location in the vicinity of the front end 30*a* of the top grip portion 30A, thereby enabling the front grip portion 41 to be directly connected, by a bolt 62 or the like (FIG. 5), with the top grip portion 30A. Further, the rear end (the other end) 40*b* of the diagonal grip portion 42 is directly coupled, by bolts 69 or the like, with a coupling boss 34 that projects from a location in the vicinity of the lower end 30*b* of the rear coupling portion 30B.

Figure 4:
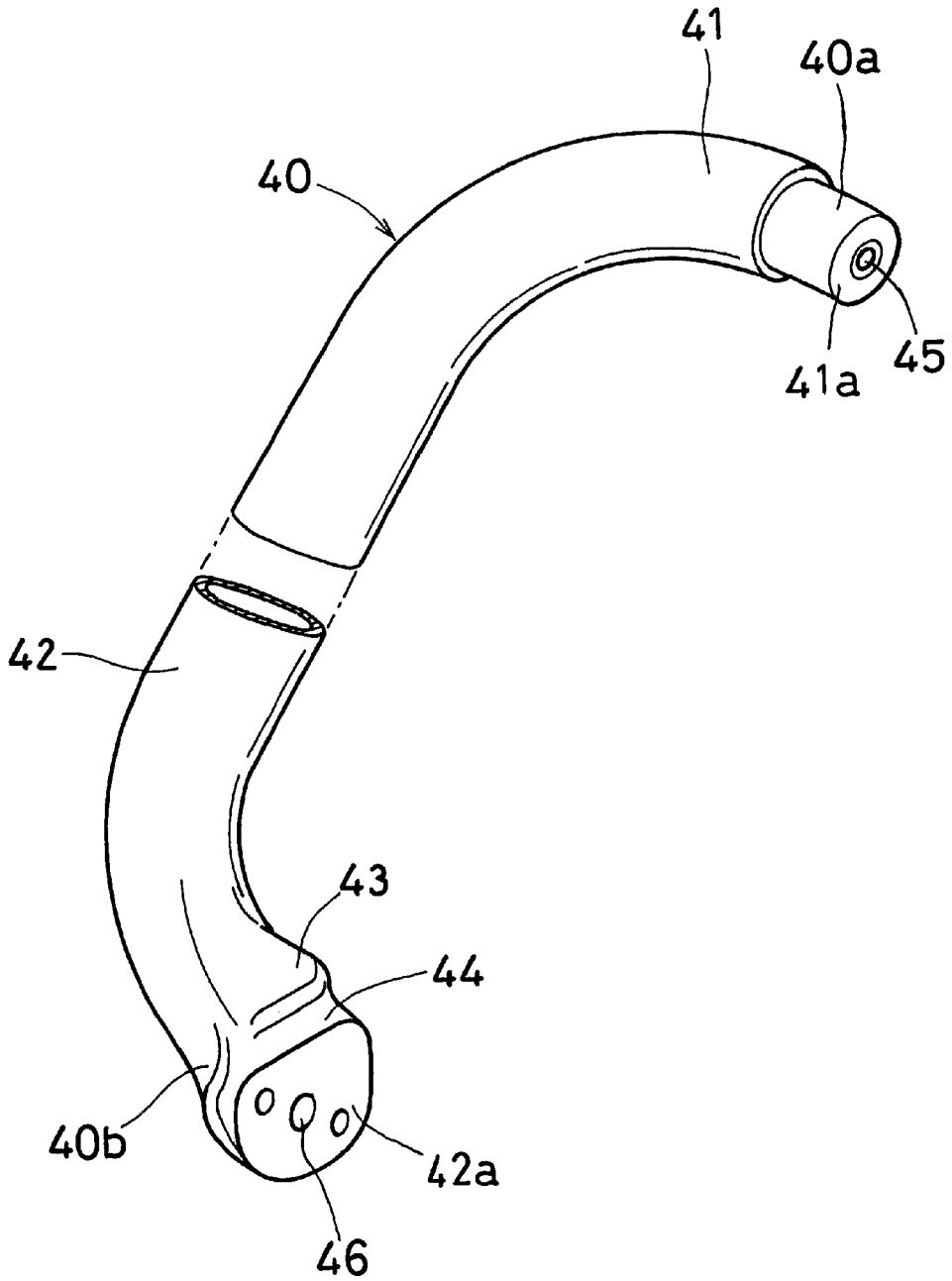
FIG. 4 is a perspective view, illustrating the side handle, which is mounted on the chain saw shown in FIG. 1.
Figure 5:
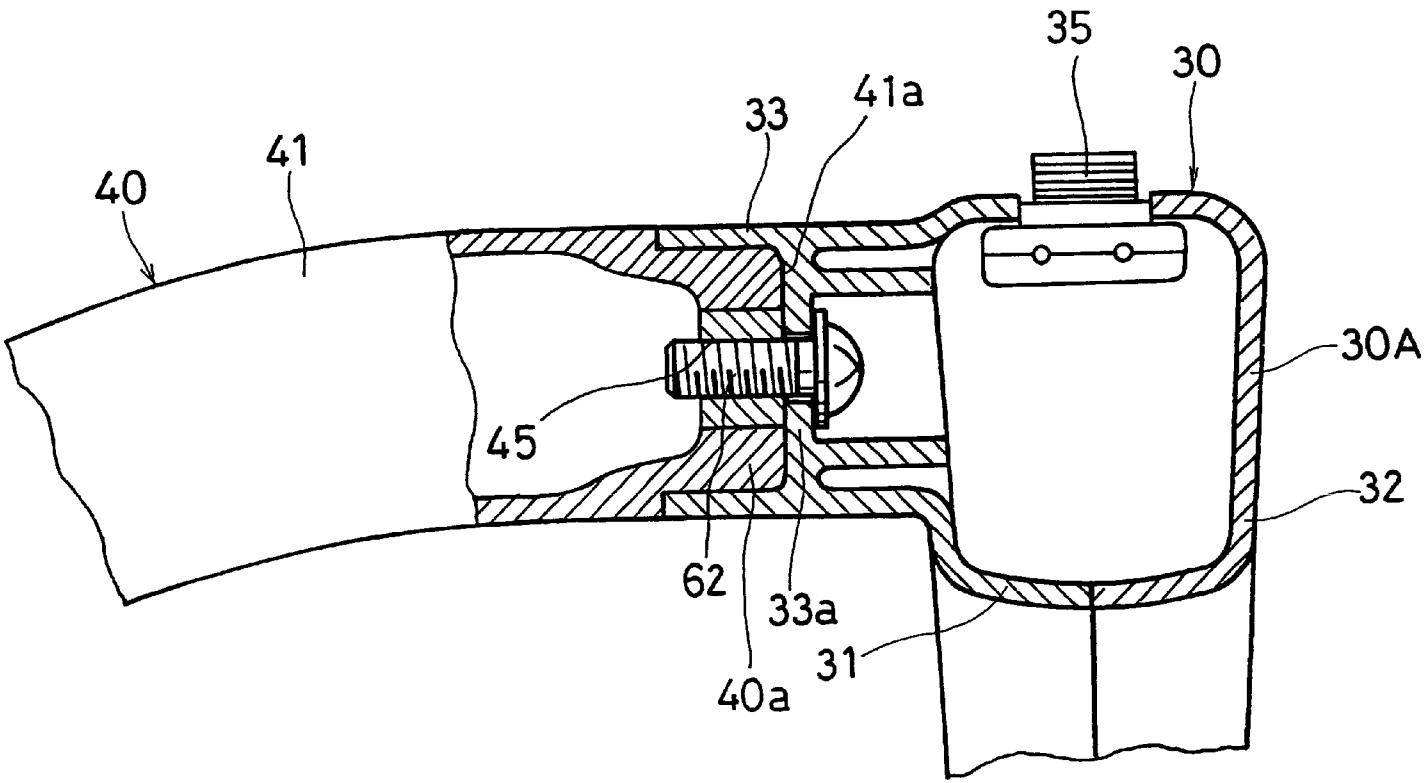
FIG. 5 is a cross-sectional view taken along the line V—V of FIG. 1.
Figure 6:
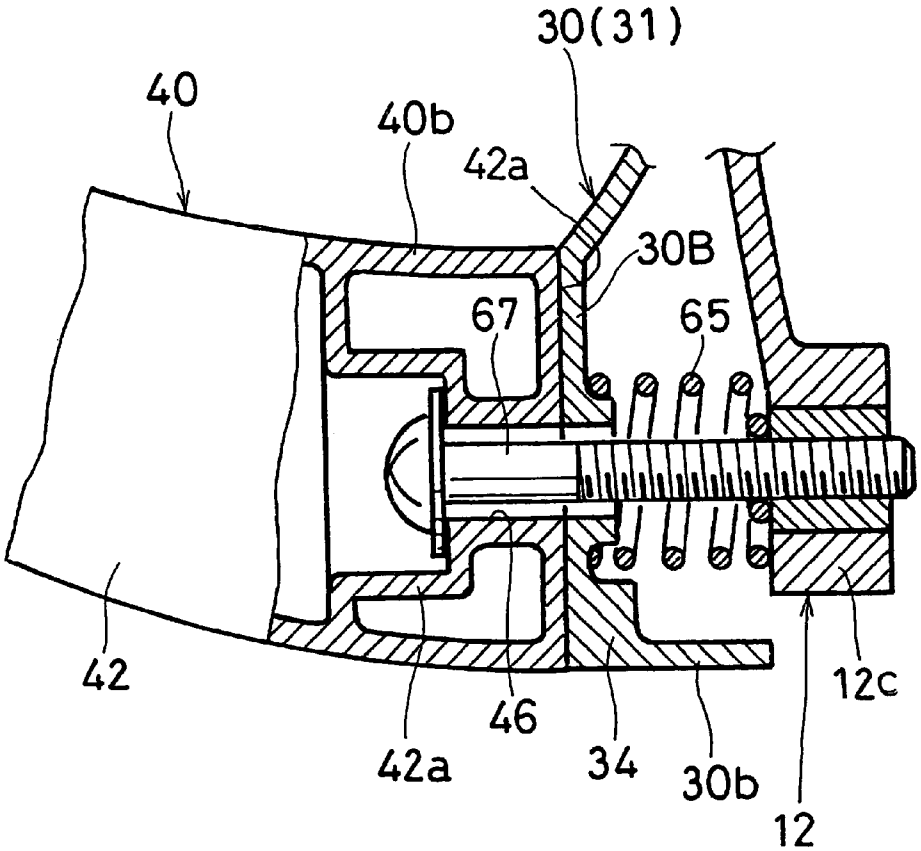
FIG. 6 is a cross-sectional view taken along the line VI—VI of FIG. 1.

As shown in FIGS. 4 to 6, the side handle 40 is provided, at the aforementioned end portion 40*a* thereof, with an end wall 41*a* having a tapped hole 45, and at the rear end 40*b* thereof, with an end wall 42*a* having a bolthole 46.

The coupling boss 34 that projects from a location in the vicinity of the lower end 30*b* of the rear coupling portion 30B of the top handle 30 and to which the end wall 42*a* of the rear end (the other end) 40*b* of the diagonal grip portion 42 as well as the rear end 40*b* of the side handle 40 are attached is interconnected, by a bolt 67 or the like, with the lower end 12*c* of the rear portion 12*b* of the main housing 12 with a vibration isolating spring 65 being interposed therebetween.

A protruding portion 43 as well as a rope-hanging portion 44 for allowing a suspending rope to be wound and secured thereto are formed at the rear end (the other end) 40*b* of the diagonal grip portion 42 of the side handle 40.

With the chain saw 10 of the embodiment, which is constructed as described above, the top handle 30 is L-shaped in the side view thereof and is constituted by the top grip portion 30A which is located above and parallel to the top surface 12*a* of the main housing 12 and extends in the longitudinal direction of the main housing 12 and by the rear coupling portion 30B which extends from the top grip portion 30A toward the rear side of the main housing 12. The front end 30*a* of the top grip portion 30A is connected with a front end portion 12*f* of the top surface 12*a* of the main housing 12, and the rear coupling portion 30B is coupled with a rear end portion 12*b* of the main housing 12. The side handle 40 is constituted by a front grip portion 41, which extends horizontally and laterally from the vicinity of the front end 30*a* of the top grip portion 30A of the top handle 30, and by a diagonal grip portion 42 which bends out and down from the front grip portion 41 and then extends diagonally straight in the side view thereof toward the lower end 30*b* of the rear coupling portion 30B. The one end portion 40*a* of the front grip portion 41 is connected directly with a portion of the top grip portion 30A, which is located close to the front end 30*a* of the top grip portion 30A. The rear end (the other end portion) 40*b* of the diagonal grip portion 42 is connected directly to the rear coupling portion 30B of the top handle 30 at a location near the lower end 30*b* thereof. As a result, the side handle (the front grip portion 41 and the diagonal grip portion 42) is easy to grip, irrespective of the working posture of the machine. Further, the operator of the portable power working machine receives a feeling of integrity between the top and side handles 30 and 40, thus making it possible to improve the operability of the machine as compared with the conventional portable power working machine wherein the other end (lower end) of the side handle is secured to a lower edge portion of the proximal (rear) end of the main housing (recoil starter case).

Since the members mounted on the main housing 12, such as the recoil starter case 12A, are attached independently of the handles 30 and 40, it is no longer required, when performing maintenance on components housed inside the main housing 12 (such as maintenance and inspection of the prime mover 70 and the recoil starter 25), to dismount the side handle 40 from the top handle 30, so that the maintenance work can be facilitated.

Inasmuch as the vibration isolating member 60 is interposed between the vicinity of the front end 30*a* of the top grip portion 30A and the top surface 12*a* of the main housing 12, and at the same time, since the vibration isolating spring 65 is interposed between the lower end 30*b* of the rear coupling portion 30B and a lower end portion 12*c* of the rear end portion 12*b* of the main housing 12, the vibration of both handles 30 and 40 can be minimized, thus giving the operator a feeling of improved integrity, and making it possible to improve the operability of the working machine.

While the foregoing embodiment of the present invention has been explained in detail above for the purpose of illustration, it will be understood that the construction of the device can be varied without departing from the spirit and scope of the invention.

For example, although the present invention has been explained in the above embodiment with reference to a chain saw, the present invention is also applicable to other kinds of portable power working machines, such as a power cutter and a hedge trimmer.

Further, although the top handle is formed as a separate body from the side handle in the above embodiment, they can be integrally formed.

As explained above, according to the portable power working machine of the present invention, it is now possible to easily grip the side handle irrespective of the working posture of the machine, to restrict transmission of vibrations of the main housing to the side handle, thereby giving the operator a feeling of integrity between the top and side handles and improving the operability of the machine, and to make it convenient for the operator to perform maintenance work on the components housed inside the main housing.

What is claimed is:

1. A portable power working machine, comprising:

(a) a main housing having a front end portion;

(b) a working member projecting forwardly from the front end portion of the main housing;

(c) a prime mover housed in the main housing;

(d) a top handle of L-shape in side elevation and including a top grip portion located above and extending over and parallel to a top surface of the main housing and extending in a longitudinal direction of the main housing, a rear coupling portion having a lower end, extending from the top grip portion along a rear side of the main housing, a front end of the top grip portion being connected with a front end portion of the top surface of the main housing, and the rear coupling portion being coupled with a rear end portion of the main housing; and (e) a side handle having one end portion which is directly connected to or molded integrally with the top grip portion of the top handle at a location close to the front end of the top grip portion and a second end portion which is connected directly to or molded integrally with the rear coupling portion of the top handle at a location close to the lower end of the rear coupling portion.

2. The portable power working machine according to claim 1, wherein said one end portion of the side handle is connected directly to the top grip portion by a bolt, and said other end portion of the side handle is connected directly to the lower end of the rear coupling portion by a bolt.

3. The portable power working machine according to claim 1, wherein the side handle is C-shaped as viewed in plan and includes a front grip portion that extends horizontally and laterally from the vicinity of the front end of the top grip portion of the top handle and by a diagonal grip portion that curves outwardly and downwardly from the front grip portion toward the lower end of the rear coupling portion.

4. The portable power working machine according to claim 1, wherein a vibration isolating member is interposed between the front end of the top grip portion of the top handle and the top surface of the main housing.

5. The portable power working machine according to claim 1, wherein a vibration isolating member is interposed between the lower end of the rear coupling portion of the top handle and a lower end portion of the rear end portion of the main housing.

6. The portable power working machine according to claim 1, wherein the working member is a chain saw set having a guide bar attached to the main housing, and a saw chain trained around the guide bar.

* * * * *